US007226284B2

(12) United States Patent
Avelar

(10) Patent No.: US 7,226,284 B2
(45) Date of Patent: Jun. 5, 2007

(54) METHOD AND APPARATUS FOR CONTROLLING A BURNING FLAME

(76) Inventor: Victor Avelar, 365 Smithfield Ave., Pawtucket, RI (US) 02860

( * ) Notice: Subject to any disclaimer, the term of this patent is extended or adjusted under 35 U.S.C. 154(b) by 87 days.

(21) Appl. No.: 10/981,922

(22) Filed: Nov. 5, 2004

(65) Prior Publication Data

US 2006/0099540 A1 May 11, 2006

(51) Int. Cl.
*F23D 3/16* (2006.01)
*F23N 5/00* (2006.01)

(52) U.S. Cl. ..... 431/33; 431/291; 431/150

(58) Field of Classification Search ..... 431/34, 431/33, 335, 289, 291, 144, 146, 148, 150, 431/126, 125; 362/161
See application file for complete search history.

(56) References Cited

U.S. PATENT DOCUMENTS

| | | | | |
|---|---|---|---|---|
| 528,439 | A | | 10/1894 | Langston |
| 613,458 | A | | 11/1898 | Miller |
| 951,791 | A | | 3/1910 | Ballentine |
| 1,083,426 | A | | 1/1914 | Baldwin |
| 1,308,215 | A | | 7/1919 | Baird |
| 2,349,072 | A | | 5/1944 | Bormann |
| 2,685,023 | A | | 7/1954 | Valle |
| 3,885,905 | A | | 5/1975 | Giangiulio |
| 3,985,492 | A | | 10/1976 | Nunemaker |
| 4,138,211 | A | | 2/1979 | Kampfer et al. |
| 4,496,307 | A | | 1/1985 | Ginardi |
| 4,497,374 | A | | 2/1985 | Millar |
| 4,516,534 | A | * | 5/1985 | Jahier ..... 122/16.1 |
| 4,557,687 | A | | 12/1985 | Schirneker |
| 4,818,214 | A | | 4/1989 | Ronnback |
| 4,869,662 | A | | 9/1989 | LeCourt et al. |
| 5,057,005 | A | * | 10/1991 | Kwok ..... 431/253 |
| 5,183,646 | A | * | 2/1993 | Anderson et al. ..... 423/210 |
| 5,197,454 | A | | 3/1993 | Lee |
| 5,282,737 | A | | 2/1994 | Ray |
| 5,363,590 | A | | 11/1994 | Lee |
| 5,487,658 | A | | 1/1996 | Lee |
| 5,609,480 | A | | 3/1997 | Boyd |
| 5,683,239 | A | | 11/1997 | Cardosi |
| 5,820,360 | A | | 10/1998 | Callahan |

(Continued)

FOREIGN PATENT DOCUMENTS

| | | | |
|---|---|---|---|
| GB | 12114 | A | 2/1912 |

(Continued)

OTHER PUBLICATIONS

International Search Report PCT/US2005/040278, dated Mar. 20, 2006.

(Continued)

*Primary Examiner*—Josiah C. Cocks
*Assistant Examiner*—Chuka C Ndubizu
(74) *Attorney, Agent, or Firm*—Wolf, Greenfield & Sacks, P.C.

(57) ABSTRACT

A method and apparatus for controlling a candle flame. A candle flame may be provided in a controllable environment, e.g., an enclosed area formed at least in part by an air-tight cover. Air may be forced into the enclosed area by an air movement device (e.g., a fan) to keep the flame burning. The flame may be extinguished by reducing (e.g., stopping) air flow into the enclosed area.

23 Claims, 4 Drawing Sheets

U.S. PATENT DOCUMENTS 5,899,685 A 5/1999 Thigpen
5,904,476 A 5/1999 Hoffman
5,944,505 A 8/1999 Kroecher
5,961,318 A 10/1999 Chambers et al.
5,971,081 A 10/1999 Stewart
5,989,012 A 11/1999 Umfleet
6,231,336 B1 5/2001 Chen
6,261,088 B1 7/2001 Butler
6,267,581 B1 7/2001 Harrison
6,296,477 B1 10/2001 Lin
6,298,922 B1 10/2001 Stewart
6,305,928 B1 10/2001 Novak
6,328,935 B1 12/2001 Buccellato
6,354,710 B1 3/2002 Nacouzi
6,382,962 B1 5/2002 Papai
6,426,051 B1 7/2002 Allison
6,435,858 B1 8/2002 Cormier et al.
6,447,286 B1 9/2002 Snuggs
6,494,708 B1 * 12/2002 Hart et al. ..... 431/33
6,572,365 B1 * 6/2003 Byxbe ..... 431/33
6,589,047 B1 7/2003 Papai
6,652,269 B1 11/2003 Stenger
6,733,279 B2 5/2004 Thigpen et al.
6,769,904 B1 8/2004 Iverson
6,783,356 B2 * 8/2004 Hermanson ..... 431/126
2002/0158351 A1 10/2002 Wohrle
2004/0048213 A1 3/2004 Byrd
2004/0091829 A1 5/2004 Mack et al.
2004/0175287 A1 9/2004 Nakatsu et al.
2004/0257798 A1 * 12/2004 Hart et al. ..... 362/96
2005/0175950 A1 * 8/2005 Waters ..... 432/209

FOREIGN PATENT DOCUMENTS

WO WO 2004014440 A 2/2004

OTHER PUBLICATIONS

Patent Abstracts of Japan, vol. 007, No. 275, Publ. No. 58153020; Sep. 10, 1983.

* cited by examiner

METHOD AND APPARATUS FOR CONTROLLING A BURNING FLAME

BACKGROUND OF INVENTION

This invention relates to controlling a burning flame, e.g., controlling the burning of a candle.

Safety is a typical concern when candles are burned in a house or otherwise where people or flammable objects are present. The open flame of a candle is capable of catching curtains, clothing or other objects on fire, or burning a person through even inadvertent contact.

Another consideration when burning candles is the tendency of high wind or other air movement to blow the flame out. As is known in the art, various devices, such as lanterns, shades, etc., have been developed to help prevent a candle flame from being extinguished by wind.

SUMMARY OF INVENTION

Aspects of the invention provide methods and apparatus for controlling the burning of a candle. As used herein, a "candle" refers to any device or substance that may have an open flame or otherwise be burned, including stick candles, votive candles, jar candles, incense, oil lamps or any other device having a wick to burn a fuel, etc. In some aspects of the invention, a candle may be burned in an enclosed area so that people and objects around the candle's flame are prevented from contacting the flame. Air flow into the enclosed area may be controlled so that the flame is extinguished when air is no longer provided into the enclosed area. For example, a fan may move air into the enclosed area, providing air for combustion. If the fan stops moving air, the flame may not receive enough air for combustion and be extinguished, e.g., within 1–2 minutes or less.

In another aspect of the invention, the environment in which a candle may be burned may be enclosed so that wind and other external factors have little or no influence on the burning of the candle. Also, the presence of flammable gases, such as natural gas or gasoline vapors, may be detected, and the flame extinguished so as to reduce the likelihood of igniting the gases.

In one aspect of the invention, a flame control system for a candle includes a cover that defines an enclosed area arranged to house a candle having a burning flame for an extended period. The burning flame may be positioned above a lowermost portion of the bottom of the cover, which may be air-tight in portions above the bottom. The cover may have an opening at the bottom to allow air to enter the enclosed area, and to allow combustion products from the flame to exit. An air supply may provide air into the enclosed area, and the flame may be extinguished when the supply of air into the enclosed area drops below a threshold level.

In another illustrative embodiment, a flame control system includes an enclosed area in which a burning flame of a candle is positionable, and an air movement device that causes air to be provided into the enclosed area for the burning flame. The enclosed area may be constructed and arranged so that when the air is not caused to be provided into the enclosed area by the air movement device, the flame is extinguished.

The system may include circuitry that detects a condition in or near the enclosed area and controls the air movement device to stop causing air to be provided into the enclosed area. The circuitry may include a sensor that detects movement of an object near the enclosed area, a presence of an object near the enclosed area, movement of the enclosed area, tipping of the enclosed area, a temperature in or near the enclosed area, or a flammable gas or vapor.

In another illustrative embodiment, a flame control system includes a controllable environment in which a candle flame may burn, and a sensor that detects a condition of an object near the controllable environment or a condition of the controllable environment, and provides an electrical signal to control the environment to extinguish the candle flame.

In another illustrative embodiment, a flame control system includes a controllable environment in which a candle flame may burn, and an air movement device that causes air to be moved into the controllable environment. A controller may control the operation of the air movement device so that the candle flame in the controllable environment is extinguished when the air movement device reduces an amount of air moved into the controllable environment.

In another aspect of the invention, a method for controlling a burning flame includes providing at least a portion of a candle in a controllable environment, and lighting the candle to produce a candle flame in the controllable environment. Air may be forced to flow into the controllable environment, and the candle flame may be extinguished by reducing the air flow into the controllable environment.

These and other aspects of the invention will be apparent and/or obvious from the following description and appended claims.

BRIEF DESCRIPTION OF THE DRAWINGS

Aspects of the invention are described with reference to the following drawings in which like numerals reference like elements, and wherein.

DETAILED DESCRIPTION

Various aspects of the invention are described below with reference to illustrative embodiments. However, it should be understood that aspects of the invention are not limited to those embodiments described below, but instead may be used in any suitable system or arrangement.

Aspects of the invention provide a controllable environment, e.g., an enclosed area, in which a candle flame may be housed and controlled. Thus, the candle flame may be housed in a cover or other structure and selectively permitted to burn, have its burn rate adjusted, and/or extinguished. The candle flame burn rate may be adjusted or the flame extinguished by controlling air flow into and/or out of the controllable environment. At least some aspects of the invention extinguish a candle flame by denying the flame air or other suitable gases in an amount needed for combustion. In addition, the cover may protect persons or flammable objects from contacting the flame.

Figure 1:
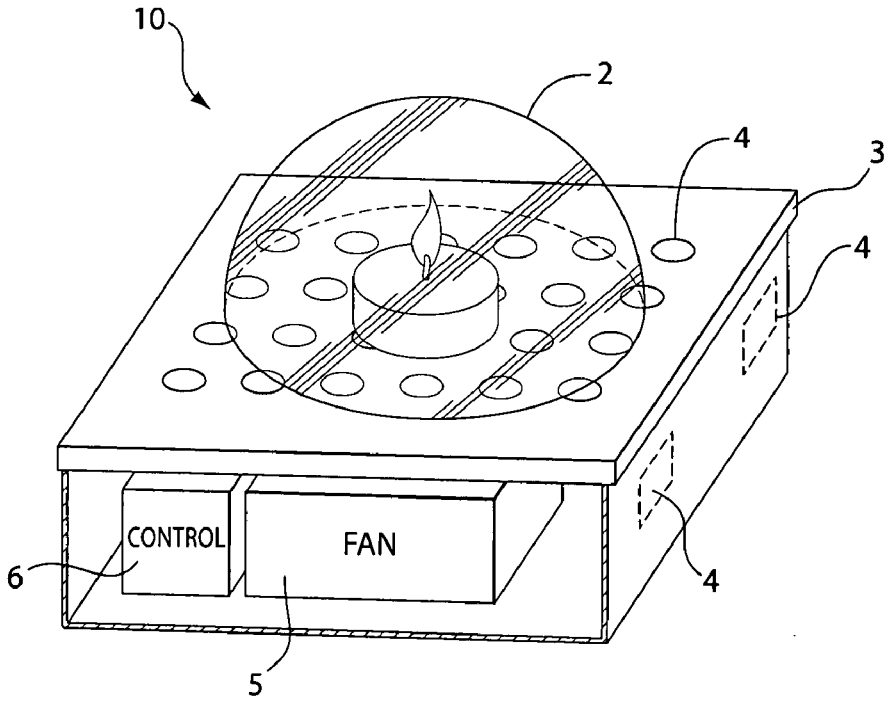
FIG. 1 is a perspective view of an illustrative embodiment of a flame control system in accordance with the invention.

FIG. 1 shows an illustrative embodiment of a flame control system 10 that incorporates various aspects of the invention. In this illustrative embodiment, a candle 1 is arranged within a cover 2 that defines an enclosed area in which the candle's flame may burn for an extended period, e.g., 1 minute, 10 minutes, 1 hour, or more. Although the cover 2 may be made in any suitable arrangement, in this embodiment the cover 2 is made of glass and has a hemispherical, bowl-like shape. The cover 2 may be air-tight, i.e., have no holes or openings to allow air to pass, above its bottom portion. In one illustrative embodiment, the cover 2 defines an interior area having a volume slightly larger than the enclosed candle with the bottom of the cover 2 having a diameter approximately 2 inches larger than the candle diameter. The candle 1 may be placed inside the enclosed area of the cover 2 on a support 3 that has at least one opening 4 that allows air to enter into the enclosed area. The support 3 and one or more openings 4 are arranged so that the candle flame extinguishes if an air movement device 5, e.g., a fan, stops supplying air through the openings 4 into the enclosed area. That is, the fan 5 moves air through the openings 4 at a rate to provide sufficient air to keep the flame burning and exhaust combustion products through the openings 4. In one embodiment, the support 3 has a flat plate with a plurality of openings 4 in at least partial registration with the opening at the bottom of the cover 2. Each of the openings 4 may have a size of about 1/16 sq. inch and be equally spaced from each other about ¼ inch apart in a grid pattern. In the illustrative embodiment, the fan has a diameter of about 2–3 inches, is rated at about 2 watts and is spaced at about ½ to 1 inch below the openings 4. If the fan 5 is stopped, the candle flame will extinguish, e.g., within a 1–2 minutes or less, as a result of insufficient air for combustion.

A controller 6 may be used to control the operation of the fan 5 and/or perform other functions. For example, the controller 6 may include one or more switches to control the power provided to the fan 5, e.g., a toggle switch that may be operated by a user to turn the fan on and off. In other embodiments, the controller 6 may control the operation of the fan 5 based on detected environmental conditions or any other suitable criteria. For example, the controller 6 may have a timer that a user may set for a desired burn period, e.g., 1 hour. The controller 6 may then allow the fan 5 to run for one hour, at which time the fan 5 may be turned off and the candle flame extinguished.

Alternately, the controller 6 may detect conditions around the cover 2 and control the fan 5 accordingly. For example, the controller 6 may include a sensor capable of detecting an object within a predetermined distance of the cover 2, e.g., by using an ultrasonic detector or other suitable device. If the object is detected to be too close to the cover 2, the controller 6 may extinguish the flame. The controller 6 may detect other conditions, such as movement or a lack of movement of a person in a vicinity of the cover 2 (e.g., using an infrared detector to detect that the candle is unattended), movement of the cover 2 to expose the candle flame, a temperature in or near the cover that is above a threshold, and/or the presence of a flammable gas or vapor (e.g., gasoline or natural gas). Based on the detected condition, a sensor may provide an electrical signal (in the form of a resistance, voltage, current level, break in continuity, digital bit or word, etc.) to the controller 6, which may control the candle flame accordingly. Detection of movement of the cover 2 may be movement of the cover 2 away from the support 3 and/or movement of the cover 2 with the support 3 (where the entire system is moved, e.g., tipped). Movement of the cover 2 apart from the support 3 may be detected by a switch associated with the support 3 that is closed when the cover 2 in place on the support 3, and opens when the cover 2 is removed. Of course, separation of the cover 2 from other portions of the control system 10 may be detected in other ways. Movement of the entire system may be detected, for example, by an accelerometer, mercury switch, etc. that changes state in response to movement of the support 3. Flammable gases and/or vapors may be detected using any suitable sensor as is known in the art.

The controller 6 may control air flow into the enclosed space by controlling the fan speed, by adjusting the number or size of openings into the enclosed space or otherwise adjusting the amount of air provided into the enclosed space. When controlling the operation of the fan, the controller 6 need not be only capable of stopping the fan, but rather may adjust the fan speed, e.g., slow the fan sufficiently to slow the candle burn or extinguish the flame. One or more openings into the enclosed space may be opened or closed or adjusted in size in any suitable way, such as by a movable damper element, one or more flow restrictors, etc. Adjustments to fan speed and/or opening size may be made by a user or by the controller 6. For example, the controller 6 may have an adjustment knob that may be used by an operator to adjust the fan speed, and thus the burn rate of the candle.

The controller 6 may also provide a visual and/or aural warning based on detected conditions or other system status information. For example, the controller 6 may display a flashing light or emit a warning tone when the cover 2 is moved or removed, the system is tipped, a high temperature condition exists, etc. The warning may prompt a user to correct a situation that if not corrected, causes the controller 6 to extinguish the flame.

The controller 6 may also include a remote control unit by which a user can provide operating instructions to the controller 6 from a distance. A user may use the remote control to extinguish a candle flame, adjust a burn timer setting, adjust a burn rate of the candle (e.g., to increase/decrease the light output or odor output of the candle), or even cause the controller 6 to automatically light the candle flame (where the controller 6 is suitably equipped). Such a remote control unit may be capable of communicating with multiple flame control systems 10, e.g., so a user could simultaneously ignite and/or extinguish the candle flames for multiple units, or may be capable of individually communicating with one or more flame control systems 10.

As is described in more detail below, the flame control system 10 may be arranged in many different ways while achieving desired flame control. In the illustrative embodiment of FIG. 1, the cover 2 is made of a translucent glass material that is air-tight, i.e., includes no holes or other openings other than an opening at the bottom of the cover 2. However, the cover 2 (as well as the support 3) may be made of any suitable material, such as a heat resistant plastic, ceramic or metal, may be transparent, translucent and/or opaque in all or some portions, and/or may have one or more openings in the portion above the cover bottom (e.g., to allow the light and/or scent of a burning candle to escape). If the cover 2 includes openings above the bottom in a configuration like that in FIG. 1, the openings may be sized, shaped or otherwise arranged so that the candle flame is extinguished when the fan 5 or other air supply reduces air flow into the enclosed space of the cover 2. In general, openings in the cover 2 may need to be sufficiently small so that the air flow into/out of the enclosed space can be controlled. It should also be appreciated that the cover 2 may be sized and/or shaped to accommodate any type of candle, such as jar candles, votive candles, stick candles, oil lamps, etc. Moreover, a candle holder, oil lamp reservoir, and/or wick support may be incorporated into the structure of the cover 2. For example, the cover 2 may be made of glass with an integral oil lamp reservoir and wick support molded into the cover 2.

The support 3 in this embodiment has a box-like shape, but may be arranged in any suitable way. For example, the support 3 may have a cylindrical shape with a diameter similar to that of the cover 2 (assuming the cover 2 has a cylindrical bottom portion as in FIG. 1). The support 3 may define a space to house the controller, air movement device and/or other components as desired. Also, the support 3 may be arranged to allow air flow into/out of a space defined by the support 3, e.g., to allow air to enter the enclosed space and allow combustion products to escape the space.

The cover 2 may include portions that have an optical effect on the candle light, such as coloring the light (e.g., by filtering), intensity enhancement (e.g., by using materials on the cover that emit light in response to being heated and/or illuminated by the candle flame), focusing or dispersing light (e.g., by using a Fresnel or other lens element or "frosting" portions of the cover 2, etc.).

The cover 2 may optionally include a well or other structure to support a substance to be heated, such as an incense, oil or other odor-producing material, either inside the enclosed space or on the cover exterior. The heat of the candle flame may heat the cover 2, which in turn may heat the substance. For example, the cover 2 in the FIG. 1 embodiment may have a depression or well formed in its top surface to hold an amount of incense. The incense may be heated by the candle flame, and give off a desired odor.

Although not shown in the FIG. 1 embodiment, the cover 2 may be selectively fixed to the support 3, e.g., so that a user cannot lift the cover 2 to expose the candle 1 without unlocking the cover 2 from the support 3. Cover 2 may be secured to the support 3 in any suitable way, such as by one or more clips, a screw-thread connection where a threaded portion of the cover at the bottom engages with a corresponding threaded portion on the support, by positioning a locking cage or other structure over the cover, etc. Also, although the FIG. 1 embodiment has the cover 2 resting on the support 3, the cover 2 may be hingedly engaged with the support so that the cover 2 can be "flipped" up to allow access to the candle 1 and "flipped" down to cover the candle. Other arrangements will be appreciated by those of skill in the art.

Figure 2:
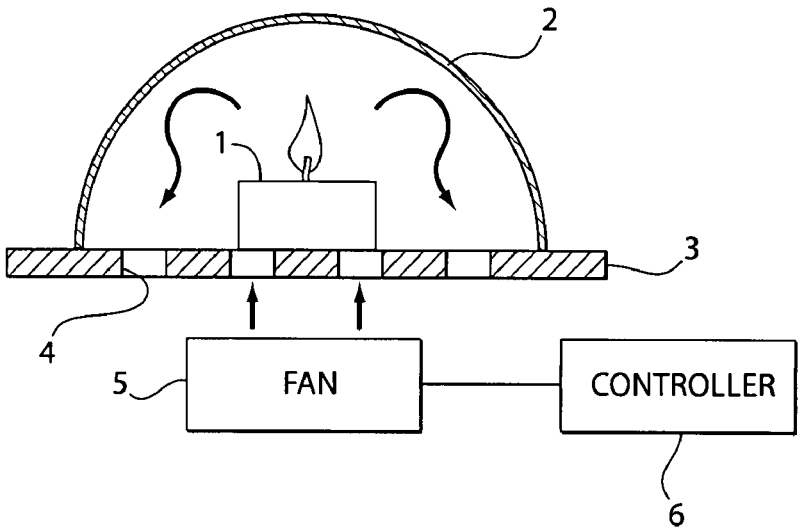
FIG. 2 shows a side view of the FIG. 1 embodiment.

FIG. 2 shows a schematic side view of the FIG. 1 embodiment and depicts air flow in the enclosed space. In this embodiment, the fan 5 blows air upwardly toward the one or more openings 4, some of which passes into the enclosed area of the cover 2. This inflow of air caused by the fan 5 causes air in the enclosed space to flow downward and exit the enclosed area through the one or more openings 4. The openings 4 are arranged so that when the fan 5 does not move air into the enclosed area, the candle flame extinguishes for a lack of air needed for combustion. Accordingly, the one or more openings 4 in the support 3 may function as a flow control member that controls the amount of air admitted/exhausted from the enclosed area. The flow control member may function to control the volume and/or speed of air flowing into/out of the enclosed area while the air movement device is operating, or may control air flow while the air movement device does not cause air to flow into the enclosed area. It is also possible to reverse the operation of the fan, i.e., to have the fan 5 remove air from the enclosed space rather that blow air into the enclosed space. Such an arrangement would likely require the fan to made so as to withstand the heat of exhaust gases in the enclosed area, unless the exhaust gases were cooled before coming into contact with the fan. In either case, the fan causes air to be moved into the enclosed area.

One potential advantage of a flame control system 10 having an air movement device, such as a fan, is that products from the combustion of the candle can be more readily spread throughout a room or space in which the system 10 is located. This may be desired, particularly where the candle gives off a fragrance or other odor. Exhaust gases from the enclosed area of the cover 2 (carrying the desired fragrance or odor) may exit through the one or more openings 4 that are not registered with the cover 2 and/or through other openings in the support 3. In the FIG. 1 embodiment, the support 3 includes a box-like frame that may have one or more openings or vents to allow air to pass into or out of the support 3. However, it should be understood that support 3 may be arranged in any suitable way.

Another advantage that may be provided by various aspects of the invention is a relatively high resistance of the candle flame to being extinguished by high winds or other air movement outside of the enclosed area. Referring to the FIG. 1 embodiment as an example, high wind around the outside of the cover 2 cannot easily enter the enclosed area to affect the candle flame. Moreover, openings in the support 3 that allow outside air to enter may be baffled or otherwise arranged to resist air entering the support 3 at high velocity and/or at a high flow rate to further reduce the effect of high wind on the candle flame.

Figure 3:
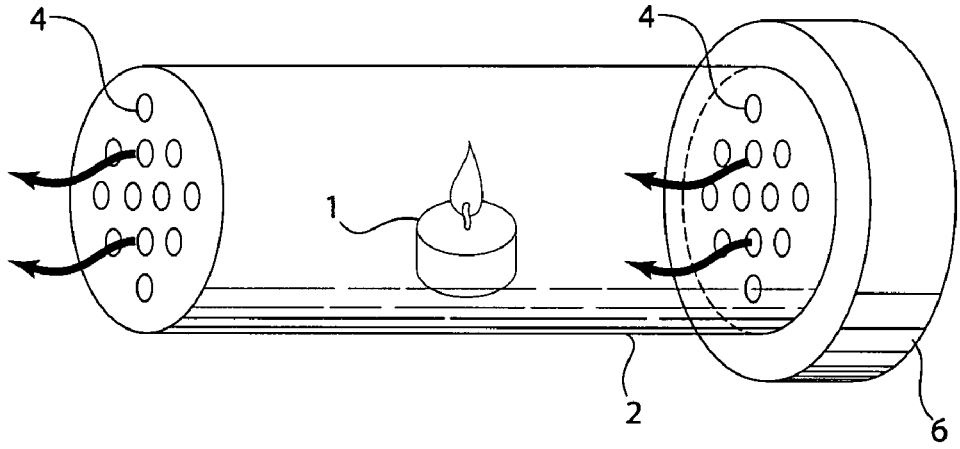
FIG. 3 shows a flame control system having an elongated cover.

FIGS. 3–8 show other illustrative embodiments of flame control systems 10 that incorporate various aspects of the invention. FIG. 3 shows an embodiment in which a candle 1 is placed in a cover 2 having a tube-like shape. Although in this embodiment the cover 2 has a cylindrical shape, it should be understood that the cover 2 may have any suitable shape, such as a square, rectangular, oval, semi-circular or other cross section. The cover 2 may have any suitable length and house any suitable number of candles. A controller 6 including an air movement device moves air into one end of the enclosed area defined by the cover 2. Of course, the air movement device may remove air from the enclosed area rather than blow air into the enclosed area as discussed above. In either case, the air movement device causes air to be provided into the enclosed area. Air is exhausted from the enclosed area through one or more openings 4 at an end of the cover 2 opposite the controller 6. The openings may be part of a flow control member that controls the flow rate of air into/out of the enclosed area. As in other embodiments, the size, shape, location or other features of the openings may be adjusted by a user and/or by the controller 6.

Figure 4:
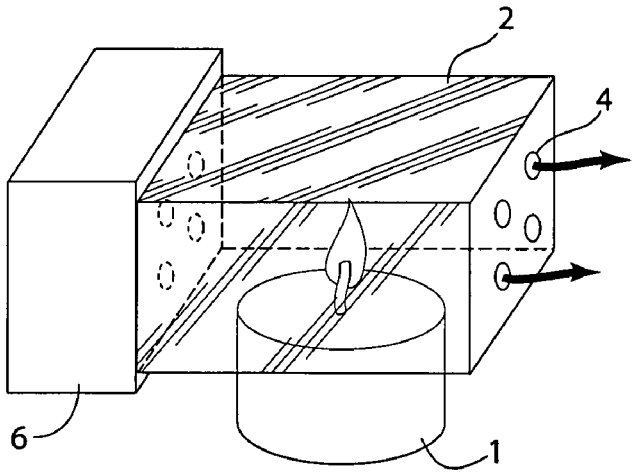
FIG. 4 shows a flame control system having a cover that fits over a top of a candle.

FIG. 4 shows another illustrative embodiment that may be used with ajar-type candle. In this embodiment, the cover 2 engages with the upper end of the jar candle so that the jar and the cover 2 together form an enclosed area for the candle flame. Similar to the arrangement in FIG. 3, a controller 6 with an air movement device causes air to be provided into the enclosed area. When the amount of air provided to the area is reduced or eliminated, the candle flame is extinguished.

Figure 5:
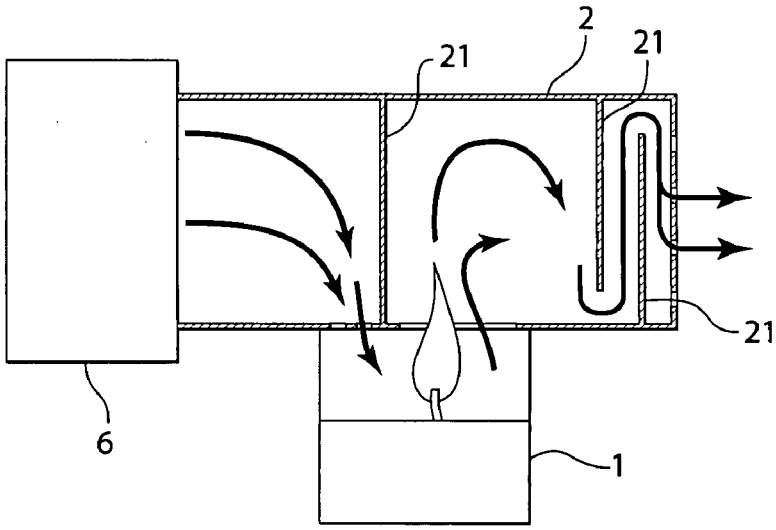
FIG. 5 shows a side view of the FIG. 4 embodiment.

FIG. 5 shows a side view of the FIG. 4 embodiment having one or more baffles 21 within the cover 2. Such baffles 21 are optional, but may be used in some cases to control the volume and/or velocity of air flow in the enclosed space, and/or direct air to flow in a certain path, such as near the candle flame as shown in FIG. 5. Baffles 21 or similar elements may be used as part of flow control member in addition to, or in place of openings 4 or other features. For example, baffles 21 may form a serpentine air flow path that serves to control air flow into/out of the enclosed area of the cover 2.

Figure 6:
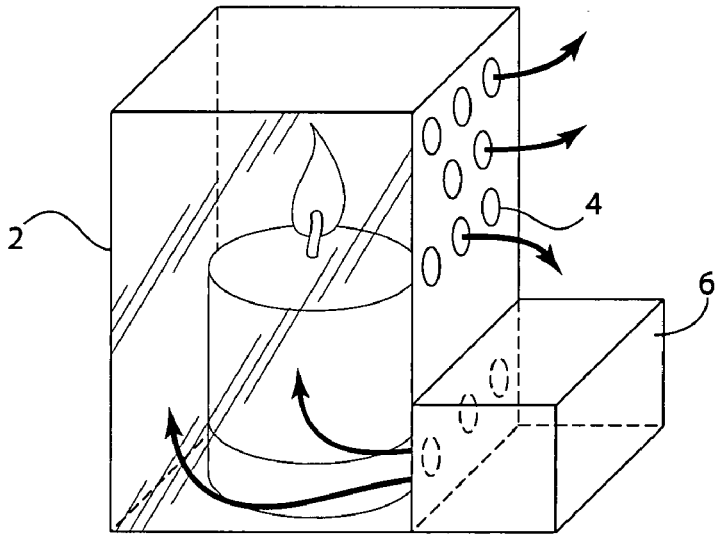
FIG. 6 shows a flame control system in which a cover rests on a table or other support.

FIG. 6 shows an illustrative embodiment in which the cover 2 has a box-like shape and the candle 1 is placed inside of the cover 2. A controller 6 with an air movement device provides air into the enclosed area of the cover 2 at a bottom end, and air is exhausted from the enclosed area through openings 4 at an upper end. As in any of the illustrative embodiments, various changes may be made, such as replacing the openings 4 with one or more baffles 21 or other flow control members. Also, the air movement device may be a fan, or any other suitable device, such as an electrostatic air movement device that moves air by accelerating charged air molecules between two oppositely charged electrodes. Such an air movement device may provide air into the enclosed area in a noiseless manner. Other air movement devices, such as a compressed air supply that releases pressurized air into the enclosed space, an air pump (e.g., like that used in fish aquariums), compressor, etc. may be used in this or any of the other embodiments. The cover 2 may have a door, removable base, or other arrangement to allow a candle 1 to be placed in/removed from the enclosed area. The cover 2 may alternately be arranged to work with a table top or other flat surface so that the candle 1 is placed on the table top and the cover 2 is placed over top of the candle 1 so that the table helps to define the enclosed area.

Figure 7:
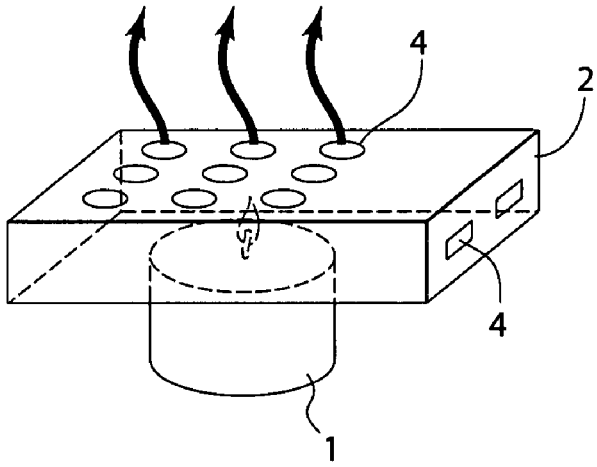
FIG. 7 shows a flame control system for use with a candle in which combustion products are exhausted upwardly.
Figure 8:
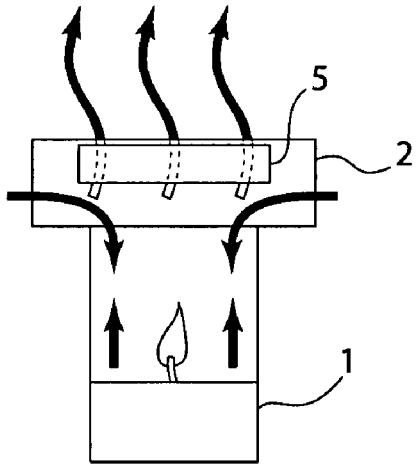
FIG. 8 shows a side view of the FIG. 7 embodiment.

FIGS. 7 and 8 show another illustrative embodiment in which a flame control system 1 is adapted to be used with jar candle or otherwise engage with the upper portion of a candle 1. In this embodiment, the cover 2 is placed over the candle 1 to form an enclosed area for the flame. A fan 5 moves air upwardly so that the air is exhausted through one or more openings 4 in an upper portion of the cover 2. In this embodiment, the fan 5 is positioned within the cover 2, and an associated controller 6, like the fan 5, may or may not be located in the cover 2. Movement of the air may cause fresh air to be drawn into the enclosed area to keep the flame burning. As in other embodiments, when the fan 5 stops or slows air movement below a threshold level, the flame is extinguished.

Although not shown in the illustrative embodiments, the controller 6 and/or air movement device may be powered by standard household electricity, batteries, solar power, etc. Another possibility is to power the air movement device and/or controller using the waste heat of the candle. For example, a Stirling engine may be powered by the heat of the candle flame and used to move air into/out of the enclosed area. The controller 6 may include any suitable electronic circuitry or other devices or components to perform desired functions. For example, the controller 6 may include a programmed microprocessor or other general purpose data processing device, user input/output devices, a visual display, speaker for producing audible signals or tones, a power supply, etc.

While aspects of the invention have been described with reference to illustrative embodiments, aspects of the invention are not limited to those embodiments described. Thus, the description herein of embodiments is intended to be illustrative, not limiting. Aspects of the invention may be used in any suitable arrangement.

The invention claimed is:

1. A flame control system for a candle, comprising:

a cover having a lower portion and defining an enclosed air tight volume above the lower portion, the cover being constructed and arranged to house a candle having a burning flame for an extended period with the burning flame being positioned above the lower portion and within the enclosed air tight volume;

a support having at least one opening and arranged to mate with the cover and support a candle positioned within the enclosed air tight volume, the at least one opening of the support communicating with the enclosed air tight volume with the cover being supported by the support; and a fan arranged to force air to move through the at least one opening in the support and into the enclosed air tight volume;

wherein the cover defines the enclosed air tight volume such that with the burning flame of a candle positioned above the lower portion of the cover and within the enclosed air tight volume, the flame of the candle continues to burn while the fan forces air to move through the at least one opening and into the enclosed air tight volume, and wherein the cover defines the enclosed air tight volume such that the flame of the candle extinguishes for lack of adequate oxygen within 2 minutes after the fan stops forcing air through the at least one opening and into the enclosed air tight volume.

2. The system of claim 1, wherein the cover includes a transparent or translucent material that allows light from the flame to pass.

3. The system of claim 1, wherein the cover has a convex shape.

4. The system of claim 1, wherein the candle is a jar candle.

5. The system of claim 1, wherein the burning flame extinguishes when a supply of air into the enclosed volume drops below a threshold level.

6. The system of claim 1, wherein the fan is located within the support and moves air in an upward direction through the at least one opening in the support and into the enclosed air tight volume.

7. The system of claim 6, wherein the burning flame extinguishes within no more than 1 minute when the fan stops moving air into the enclosed air tight volume.

8. The system of claim 1, further comprising a controller that controls the operation of the fan.

9. The system of claim 8, wherein the controller includes a sensor that detects the presence of a human within a vicinity of the cover, and is adapted to control the fan to reduce a flow of air into the enclosed air tight volume and thereby extinguish the burning flame when no human is detected in the vicinity of the cover.

10. The system of claim 8, wherein the controller includes a timer and controls the fan to reduce a flow of air into the enclosed air tight volume and thereby extinguish the burning flame after a period of time has elapsed.

11. The system of claim 1, wherein the support includes a flow control member that at least partially controls the flow of air in the enclosed volume.

12. The system of claim 11, wherein the cover has an opening through which air flows into the enclosed volume, and wherein the flow control member is arranged to control air flow through the opening.

13. The system of claim 12, wherein air for combustion passes through the flow control member into the enclosed volume, and materials produced by the burning flame pass through the flow control member out of the enclosed volume.

14. The system of claim 13, wherein the fan blows air through the flow control member into the enclosed volume.

15. The system of claim 11, wherein the fan causes the materials produced by the burning flame to pass through the flow control member.

16. The system of claim 11, wherein the flow control member includes a plate associated with a plurality of holes.

17. The system of claim 16, wherein the candle is placed on the plate, and wherein the cover is positioned over the plate and the burning flame.

18. The system of claim 1, further comprising circuitry that detects a condition in or near the enclosed volume and controls the fan to reduce a flow of air provided into the enclosed volume.

19. The system of claim 1, further comprising a controller that includes a sensor that detects at least one of movement of an object near the enclosed volume, a presence of an object near the enclosed volume, movement of the enclosed volume, tipping of the enclosed volume, a temperature in or near the enclosed volume, or a flammable gas or vapor, and wherein the controller controls the fan based on a condition detected by the sensor.

20. The system of claim 1, wherein the cover is translucent or transparent.

21. The system of claim 1, wherein the fan is located within the support.

22. The system of claim 1, wherein air flow into the enclosed volume is controllable to adjust a burn rate of the candle.

23. The system of claim 1, further comprising a switch that detects a presence of the cover being mated with the support, and wherein the fan is controllable based on a state of the switch.

* * * * *